United States Patent [19]

Knight et al.

[11] Patent Number: 4,566,821

[45] Date of Patent: Jan. 28, 1986

[54] CONFORMABLE FASCINE

[75] Inventors: Derek I. Knight, Bournemouth; Gilbert Sullivan, Highcliffe-on-Sea, both of England

[73] Assignee: The Secretary of State for Defence in Her Britannic Majesty's Government of the United Kingdom of Great Britain and Northern Ireland, London, England

[21] Appl. No.: 674,801

[22] Filed: Nov. 26, 1984

[30] Foreign Application Priority Data

Dec. 6, 1983 [GB] United Kingdom ..... 8332525

[51] Int. Cl.[4] ..... E01C 9/08

[52] U.S. Cl. ..... 404/35; 404/71; 14/1; 405/15; 405/19

[58] Field of Search ..... 14/1; 404/17, 35, 70–73; 405/15–19; 52/227

[56] References Cited

U.S. PATENT DOCUMENTS 3,258,800 7/1966 Robinsky ..... 14/1 X
3,349,526 10/1967 Schuster ..... 52/227 X
3,685,403 8/1975 Domnick ..... 404/35
4,152,875 5/1979 Soland ..... 405/19 X
4,312,601 1/1982 Allen ..... 404/35

*Primary Examiner*—Stephen J. Novosad
*Assistant Examiner*—William P. Neuder
*Attorney, Agent, or Firm*—Pollock, Vande Sande and Priddy

[57] ABSTRACT

A fascine capable of conforming to the contours of a supporting surface, comprises a core of cylindrical pipes loosely disposed within a surrounding flexible sleeve comprised of similar pipes transversely and continuously interconnected by tensioned flexible ties. All the pipes are capable of elastic cross-sectional deformation, the sleeve pipes being held in diametral compression by the flexible ties to provide increased resistance to external compression forces acting substantially perpendicularly to the direction of diametral compression, and the core pipes being selected to have less resistance to deformation than the sleeve pipes so as to absorb external point loading forces acting on the sleeve pipes. The fascine is suitable for use by both wheeled and tracked vehicles.

8 Claims, 2 Drawing Figures

CONFORMABLE FASCINE

Figure 1:
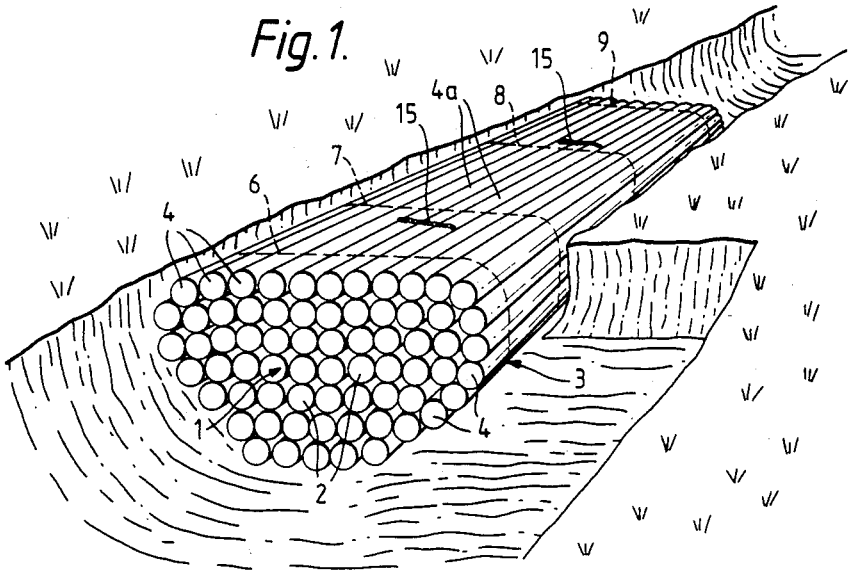

This invention relates to a fascine capable of conforming to the countours of a ditch or other ground discontinuity.

It is well-known to fill a ditch with fascines comprising tightly bound cylindrical bundles of sticks, rods or pipes in order to reduce the discontinuity sufficiently to allow passage of a tracked vehicle. Such fascines are not suitable for the passage of a wheeled vehicle as the remaining surface discontinuities are too great. Of course, the smaller the fascine and the greater the number used to fill a given volume, the smaller the remaining discontinuities will be, but depolyment and recovery of the fascines then becomes too unmanageable and time consuming.

It is also know to lay fascine mats of flexibly interconnected parallel tubes across the top of a ditch filled in this manner in order to reduce discontinuities still further and to give increased stability, but again deployment and recovery problems are increased.

A conformable fascine embodying the fascine mat principle but simplifying deployment and recovery procedures has been described in GB No. 2045319B, in which a loose bundle of pipes is surrounded by a continuous sleeve of flexibly interconnected similar pipes, which sleeve is slackened in deployment and tightly compacted for recovery. In its deployed configuration this fascine conforms to the contours of a discontinuity so as to present a continuous upper surface suitable for the passage of wheeled vehicles. This surface is not so suitable however for the passage of tracked vehicles as the tubes of the slackened sleeve have very little resistance to crushing forces imparted by the tracks of an over-passing vehicle and are consequently susceptible to fracture.

The present invention seeks to provide an easily deployed conformable fascine suitable for wheeled vehicles which can also be used by tracked vehicles without impairment.

In accordance with the present invention a conformable fascine includes a core comprising a multiplicity of tubular core members each capable of elastic cross-sectional deformation when subject to transverse compression forces, and all freely disposed in axially parallel relationship, and a sleeve circumjacent the core comprising a multiplicity of axially parallel tubular sleeve members all transversely and continuously interconnected by at least two axially spaced flexible tie means each disposed as a continuous loop, the sleeve members being conjointly maintained in transverse compression by the tie means.

Preferably the sleeve members are of circular cross-section and provided with at least two axially spaced sets of diametral perforations through which each respective tie means is sequentially threaded, to be subsequently tensioned and joined end to end to form the continuous loop. The resulting tensioned loop holds each sleeve member in diametral compression thereby to increase its resistance to crushing forces applied in a direction substantially perpendicular to the direction of compression, such as those imparted to the upper sleeve members of the deployed fascine by an overpassing vehicle.

The flexible tie means are preferably chains, particularly when the fascine is to be subjected to heavy loading and heavy diametral compression of the sleeve members is required, but cables or ropes may be alternatively employed in accordance with the degree of compression needed for other specific uses.

Preferably the core members have less resistance to cross-sectional deformation than the sleeve members so as to provide flexible support to those sleeve members that are superjacent the core in use, thereby to distribute and absorb point loading forces such as those imparted to the sleeve members by the tracks of an overpassing vehicle, and thereby to reduce still further the risk of crushing the sleeve members.

In a preferred arrangement of the invention, the core members and the sleeve members are all of circular cross-section having substantially equal external diameter and all of equal length, the length being selected to accommodate the width of the widest vehicle to be supported. Preferably they are all open ended pipes of a plastics material. When identical material is employed for both the sleeve and the core members, the core members are conveniently of thinner wall thickness than the sleeve members, so as to provide the desired reduction in resistance to cross-sectional deformation.

The crush resistance of the sleeve members may be further increased by the addition of tubular reinforcement liners of plastics material or metal contained within the sleeve members.

Conveniently, recovery fittings may be provided at three or more equally spaced perimetral locations of the sleeve, and retaining nets may be attached at each end of the sleeve, so as to prevent the core members from sliding out of the sleeve during handling and transit.

Figure 2:
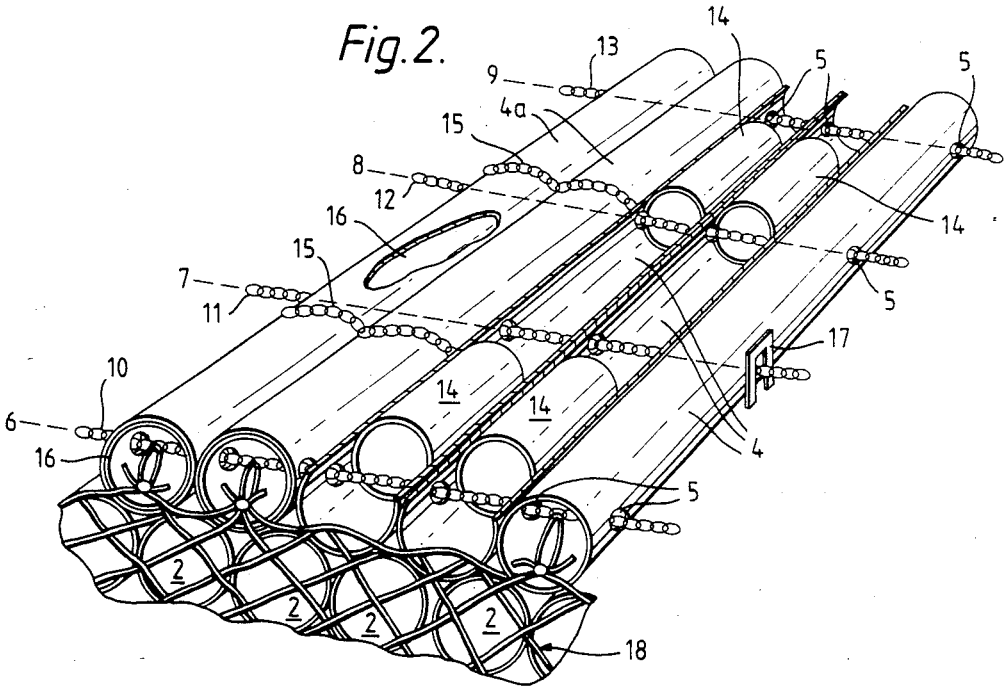

An embodiment of the invention will now be described by way of example only with reference to the accompanying drawings of which FIG. 1 is a perspective view of a conformable fascine deployed in a ditch which is illustrated part cut-away for clarity, and FIG. 2 is a perspective, part-sectioned view of a portion of the sleeve of the same fascine.

The fascine illustrated in FIG. 1 has an inner core 1 comprised by a multiplicity of core members 2 and an outer sleeve 3 comprised by a multiplicity of sleeve members 4, all of which members 2 and 4 consist of equal lengths of high density polyethylene pipe of approximately 200 mm outside diameter, each member 2 and 4 having a wall thickness of 8 mm and 10 mm respectively. The pipes may alternatively be of polypropylene.

The sleeve members 4, which are shown in greater detail in FIG. 2, each have diametrically opposed perforations 5 in each of four transverse planes 6 to 9. Four chains 10 to 13 comprising the tie means are threaded through the perforations 5 in the four planes respectively and each connected end to end to interconnect the sleeve members 4 so as to form the continuous sleeve 3.

Each sleeve member 4 contains two reinforcement liners 14 consisting of a short length of polyethylene pipe of approximately 7 mm wall thickness. The two liners 14, which are each a sliding fit within the sleeve member 4, are retained interjacent the planes 6 and 7 and the planes 8 and 9 by the chains 10 and 11 and the chains 12 and 13 respectively, so as to provide reinforcement at axial locations coincident with the track paths of an overpassing vehicle.

Recovery fittings consisting of chain loops 15 are secured around selected pairs of sleeve members 4, ie recovery sleeve members 4*a*, at four equally spaced perimetral locations of the sleeve 3, to permit attachment of recovery strops (not shown) to the fascine in any deployed position.

Each recovery sleeve member 4*a* may be provided with additional reinforcement by the use of full length liners 16 in place of the two short liners 14 of the other sleeve members 4, the liners 16 being perforated to correspond with the perforations 5 of the containing sleeve member 4*a*.

Construction of the sleeve is as follows. The liners 14 and 16 are inserted and appropriately located within their respective sleeve members 4 and 4*a*, and two of the chain loops 15 are looped as a figure of eight around each of the four pairs of sleeve members 4*a*. All the sleeve member 4 and 4*a* are then assembled side by side in desired sequence on a level surface and the chains 10 to 13 threaded through the respective perforations 5, the two chain loops 15 of each pair of sleeve members 4*a* being disposed interjacent the chains 10 and 11, and the chains 12 and 13 respectively. An open-ended, slotted stop-plate 17 is then slid onto one of the chain links at one extreme end of each chain 10 to 13 so as to locate against the first of the assembled sleeve members, and the chains are strained into tension throughout the conjoined sleeve members by a winch (not shown) acting against the last sleeve member at the other extreme end of the chain.

The chains 10 to 13 are tensioned until the desired degree of diametral compression of the sleeve members is achieved, in this particular example a pressure of one ton is applied. A second stop plate 17 is then slid onto the chain link immediately adjacent the last sleeve member at the pulling end of each chain, excess chain is then removed, and the two stopped ends are brought together and interconnected to form the sleeve 3. The stop plates 17 are then removed with a hammer.

Conveniently the chains 10 to 13 may be pre-cut to the exact length required in the stressed condition and fitted at each end with a chain coupler (not shown). The chain can then be extended for assembly purposes by an additional length of coupled-on chain (not shown) which is simply removed when the second stop plate 17 has been applied, the chain couplers then being used to interconnect the two stopped ends of each chain.

After construction of the sleeve 3, the core members 2 are loaded into the sleeve with a packing density which is dense enough to maintain the top surface of the sleeve substantially ripple-free in deployment, but not so dense as to inhibit relative movement of the component members sufficiently to diminish the conformability of the whole. It has been found with the present embodiment that a satisfactory compromise betwee these two requirements can be achieved by selecting a value of approximately 1.7:1 for the ratio S:nC, where S is the cross-sectional area of the interior circumference of the sleeve, C is the cross-sectional area of each core member and n is the total number of core members, but acceptable performance of the fascine, to varying degrees of excellence, will still be obtained with both smaller and larger ratios. The acceptable limits are of course dictated by the particular configuration to which the fascine will be conformed in deployment and the particular use to which it will be put.

After packing, the core members 2 are restrained from egress from the sleeve by attachment of retaining nets 18 to each of the chains 10 and 13 within the sleeve members 4 so as to wholly enclose the core 1.

The fascine can be made in standard sizes assembled from pre-selected numbers of sleeve members 4 and core members 2 and can be used slightly or in multiples to fill any particular ditch. Alternatively where the approximate size of a ditch to be crossed is known in advance, the fascine may be made roughly to measure, the total number of sleeve members and the length of the tie means at the desired degree of sleeve member compression being calculated to fit the approximate periphery of the ditch section and the number of core members being calculated to pack the sleeve to the chosen packing density.

An exact fit is not essential, as a satisfactory crossing can be made even when the ditch is partially underfilled or overfilled. When the opposing banks of the ditch are at different levels the fascine can be deployed with a appropriately inclined upper surface.

The embodiment described has been found capable of supporting tracked vehicles weighing up to 60 tonnes without serious impairment.

Pipe fascines in accordance with the present invention can be used with advantage in a water course, as their open construction does not impede water flow. They consequently provide a useful alternative to temporary bridge structures and can also be employed as false work for building permanent bridge structures. The invention may be further deployed as a ramp permitting a wheeled or tracked vehicle to ascend or descend steps.

The inert plastics material used to provide the desired degree of elasticity for the embodiment described also eases storage problems in comparison with the widely used wooden fascines of the prior art, as no protection from weather is necessary.

We claim:

1. A conformable fascine including a core comprising a multiplicity of tubular core members each capable of elastic cross-sectional deformation when subject to transverse compression forces, and all freely disposed in axially parallel relationship, and a sleeve circumjacent the core comprising a multiplicity of axially parallel tubular sleeve members each of which is capable of elastic cross-sectional deformation when subject to transverse compression forces, all of said sleeve members being transversely and continuously interconnected by at least two axially spaced flexible tie means each disposed as a continuous loop, said sleeve members being conjointly maintained in transverse compression by said tie means.

2. A fascine as claimed in claim 1 wherein said sleeve members are of circular cross-section, each having diametral perforations through which said flexible tie means are threaded, thereby to maintain the sleeve members in diametral compression.

3. A fascine as claimed in claim 1 wherein said core members have less resistance to cross-sectional deformation than said sleeve members.

4. A fascine as claimed in claim 3 wherein said core members and said sleeve members are all of similar material, all of circular cross section and all of substantially equal external diameter, core members being of thinner wall thickness than sleeve members.

5. A fascine as claimed in claim 1 wherein said sleeve members contain reinforcement liners located interjacent and axially spaced tie means.

6. A fascine as claimed in claim 1 wherein said core members are restrained from axial egress from sleeve by retaining nets secured so as to extend across each end of the sleeve.

7. A fascine as claimed in claim 1 wherein recovery fittings are attached to the sleeve at least three equally spaced perimetral locations.

8. A method of constructing a conformable fascine including the steps of:

a. providing a multiplicity of identical plastics material tubes with diametrical perforations at at least two axially spaced loctions, thereby to comprise sleeve members, b. arranging the sleeve members side by side on a level surface with their diametral perforations in alignment, c. threading a length of chain through each aligned set of perforations, d. securing one protective extremity of one of the chains to a tensioning means operative against the adjacent end sleeve member and applying an open-ended, slotted stop plate to the other protrusive extremity, e. straining the chain into tension with the tensioning means so as to compress all the sleeve members conjointly, f. applying a second open-ended slotted stop plate to the chain adjacent the end sleeve member nearest the tensioning means so as to maintain the compression, g. removing the tensioning means and the excess chain beyond the stop plates, h. repeating the steps c to g for each chain, i. bringing the two stopped ends of each chain together and joining them to form a continuous loop, thereby to form the sleeve members into a sleeve, j. removing the slotted stop plates from each chain, and k. loosely filling the interior of the sleeve with a multiplicity of core members comprised by plastics material tubes of thinner wall-section that those of the sleeve members.

* * * * *